US006904618B2

(12) United States Patent
Musal

(10) Patent No.: US 6,904,618 B2
(45) Date of Patent: Jun. 14, 2005

(54) SPORTS HELMET WITH ADJUSTABLE VENTILATION

(75) Inventor: Michael J. Musal, Soquel, CA (US)

(73) Assignee: Bell Sports, Inc., Santa Cruz, CA (US)

( * ) Notice: Subject to any disclaimer, the term of this patent is extended or adjusted under 35 U.S.C. 154(b) by 0 days.

(21) Appl. No.: 10/462,270

(22) Filed: Jun. 16, 2003

(65) Prior Publication Data

US 2004/0250339 A1 Dec. 16, 2004

(51) Int. Cl.[7] ..... A63B 71/10
(52) U.S. Cl. ..... 2/425; 2/410
(58) Field of Search ..... 2/424, 410, 171.3, 2/425, 422, 184.5

(56) References Cited

U.S. PATENT DOCUMENTS

| | | | | | |
|---|---|---|---|---|---|
| 3,496,854 | A | * | 2/1970 | Hill et al. | 454/370 |
| 4,698,856 | A | | 10/1987 | Arai | 2/425 |
| 4,731,885 | A | | 3/1988 | Nava | 2/424 |
| 4,995,117 | A | * | 2/1991 | Mirage | 2/410 |
| 5,093,938 | A | | 3/1992 | Kamata | 2/424 |
| 5,165,116 | A | * | 11/1992 | Simpson | 2/424 |
| 5,170,511 | A | | 12/1992 | Kamata | 2/424 |
| 5,388,277 | A | | 2/1995 | Taniuchi | 2/422 |
| 5,388,278 | A | | 2/1995 | Taniuchi | 2/422 |
| 5,394,566 | A | | 3/1995 | Hong | 2/424 |
| 5,915,537 | A | | 6/1999 | Dallas et al. | 2/410 |
| 6,105,172 | A | * | 8/2000 | Shida | 2/171.3 |
| 6,170,090 | B1 | * | 1/2001 | Minor | 2/411 |
| 6,263,513 | B1 | * | 7/2001 | Murakami | 2/171.3 |
| 2002/0124298 | A1 | * | 9/2002 | Muskovitz | 2/410 |

FOREIGN PATENT DOCUMENTS

| | | | | | |
|---|---|---|---|---|---|
| DE | 4009036 | A1 | * | 9/1991 | A42B/3/00 |
| JP | 04018106 | A | * | 1/1992 | A42B/3/24 |
| JP | 06041807 | A | * | 2/1994 | A42B/3/28 |

* cited by examiner

*Primary Examiner*—Rodney M. Lindsey
(74) *Attorney, Agent, or Firm*—Womble Carlyle Sandridge & Rice, PLLC

(57) ABSTRACT

A helmet for protecting the head of a wearer during sporting activities, comprising a protective shell, vents formed in the protective shell, and a shutter plate positioned within the protective shell. The shutter plate has apertures conforming in dimension and position to the vent openings so that that the apertures are in substantial alignment with the vents when the shutter plate is in a first position. The shutter plate is selectively moveable so that the vents are opened or closed.

14 Claims, 5 Drawing Sheets

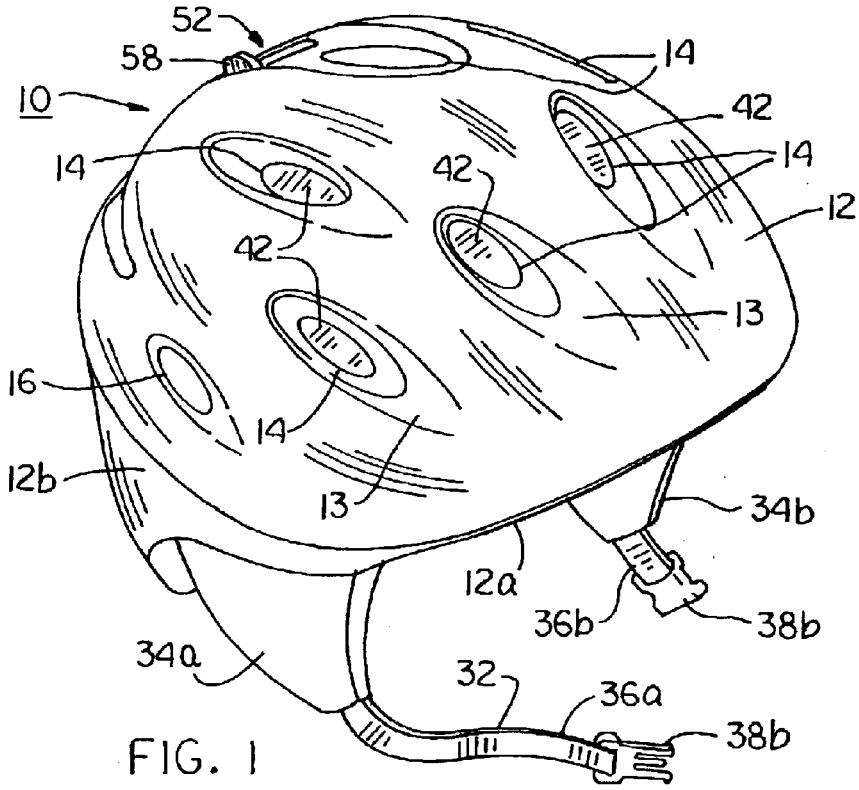
FIG. 1
FIG. 3
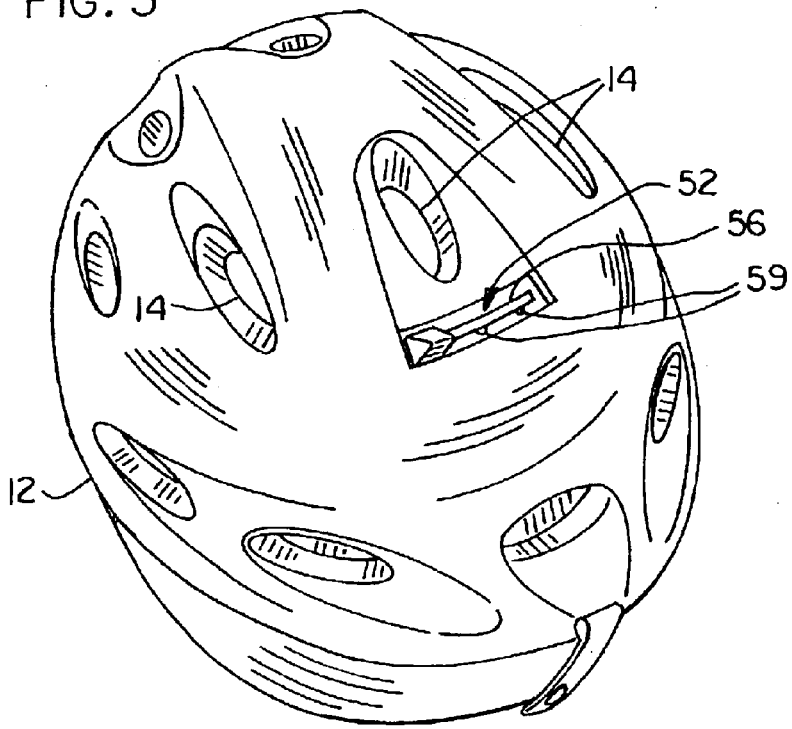

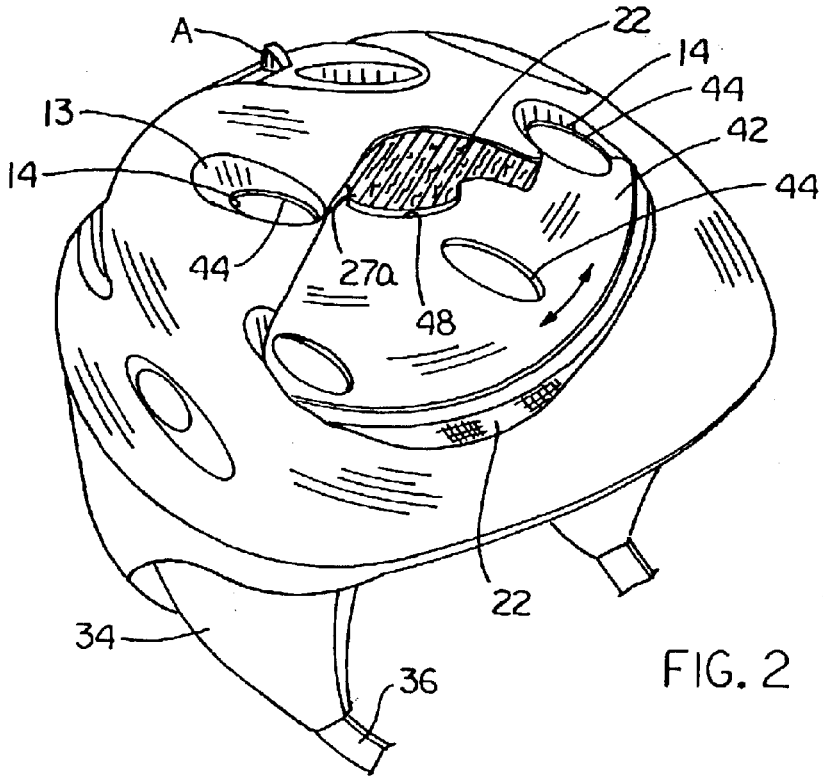
FIG. 2
FIG. 9
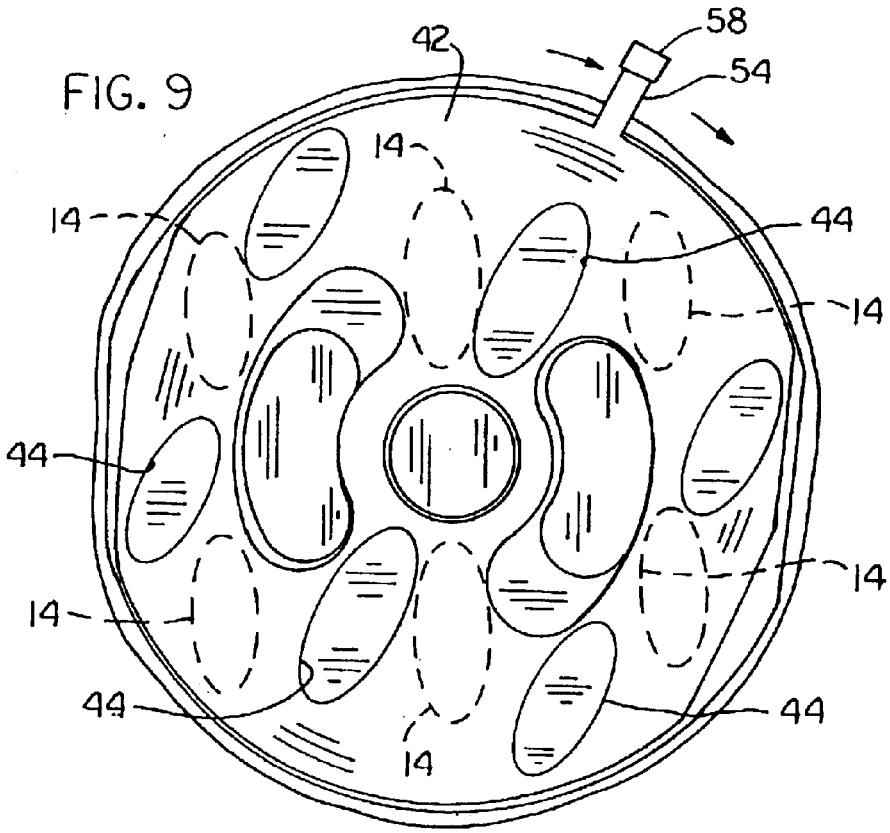

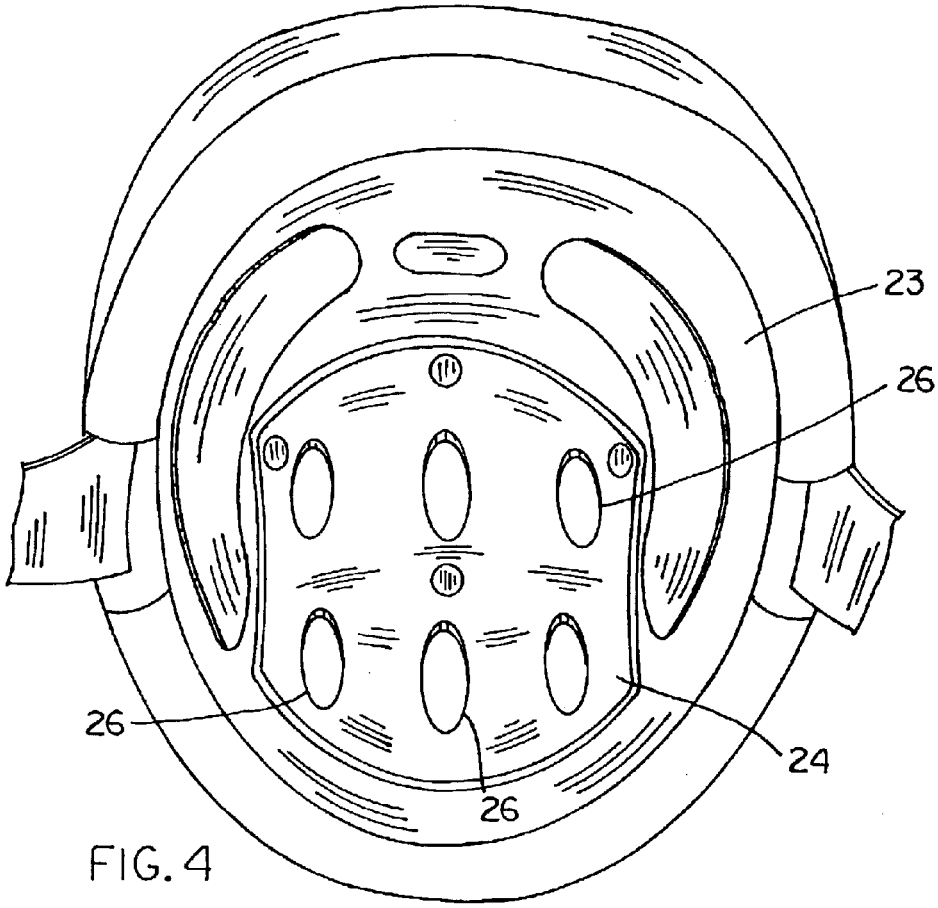
FIG. 4
FIG. 5
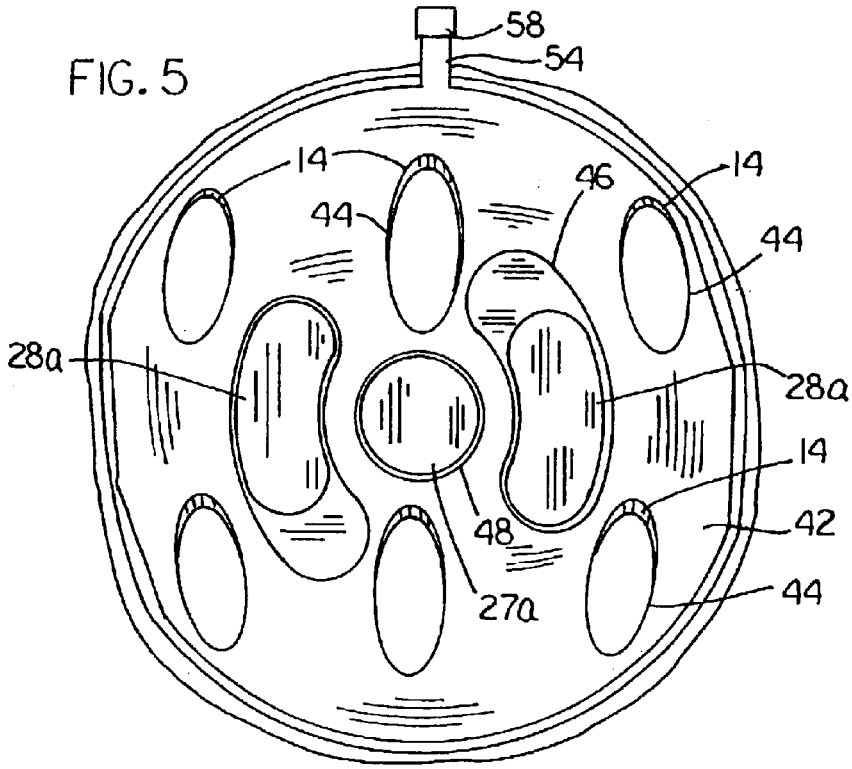

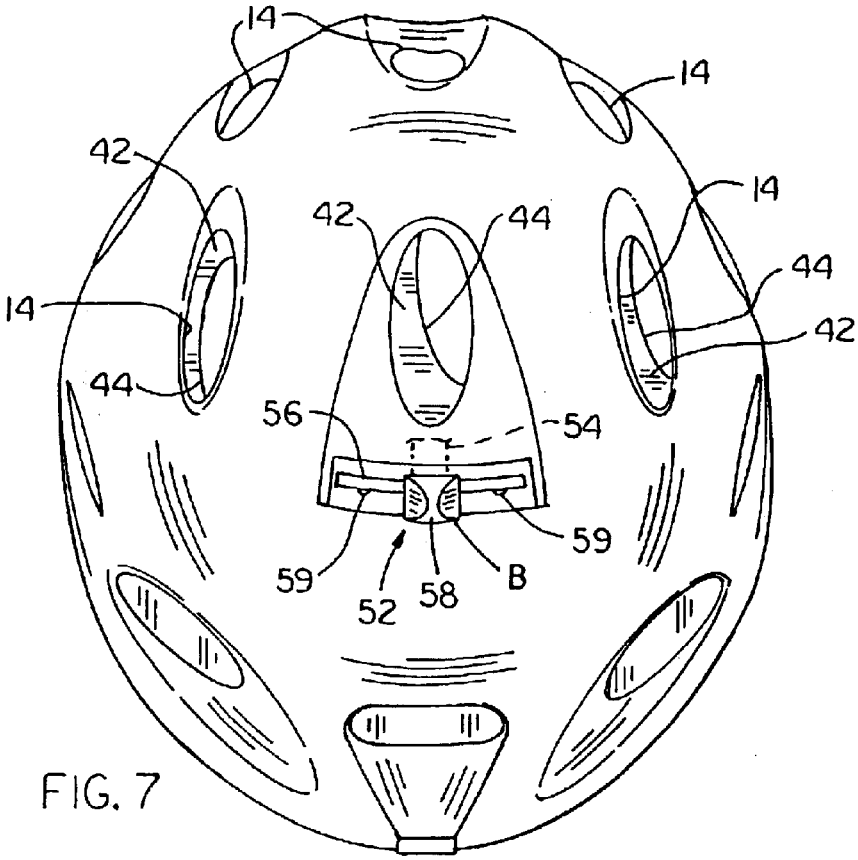
FIG. 7
FIG. 8
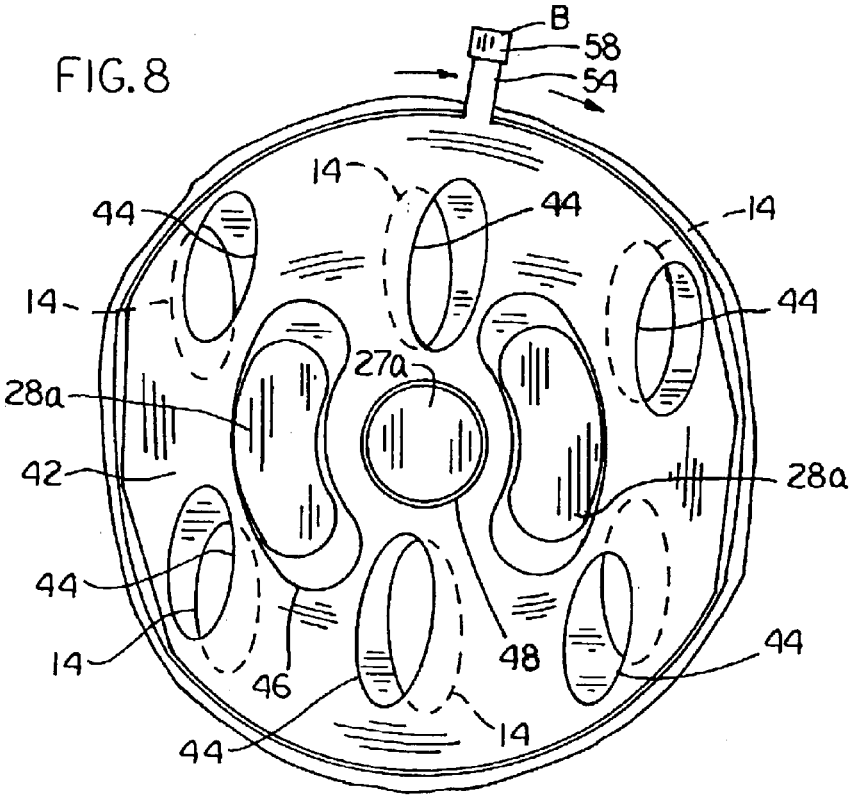

SPORTS HELMET WITH ADJUSTABLE VENTILATION

FIELD OF THE INVENTION

The present invention relates to the field of protective apparel, and more particularly, to helmets for outdoor sporting activities.

BACKGROUND OF THE INVENTION

Helmets and other forms of protective headgear have become increasingly popular in recent years as users have become more aware and concerned about preventing head injuries while participating in individual and team sporting events. Numerous forms of special helmets have been developed for wear in a wide range of indoor and outdoor sporting activities.

While the helmets developed for some activities are compact and intended to protect the more vulnerable areas of the head and neck, others cover a more substantial portion of a user's head. For example, helmets for motorcyclists tend to be expansive and cover not only the head, but often comprise a faceshield to protect the wearer from debris and flying objects that may be encountered at driving speeds. Because these helmets cover substantially the entire head and neck of the wearer, the interiors of these helmets tend to become uncomfortably warm, especially in warm weather. This often leads to fogging of the faceshield as condensation builds inside the helmet. To combat this problem, vents have been incorporated into some helmet constructions to intake, circulate, and discharge air. This, of course, is possible since forced ventilation is ensured by the velocity of incoming air due to the speed of driving. As such, these vents often are located on the front facial portions of the helmets. Although such a configuration is somewhat effective in ventilating the facial area, it does not provide ventilation to the crown of the wearer's head.

In sports such as snowboarding and skiing, ventilation measures for the head heretofore have not been highly effective. One known helmet construction incorporates small apertures around the headband region for some air exchange and evaporation of perspiration, but lacks any effective ventilation provision for the top of the head. As is well known, the top, or crown, of the head is where the average person radiates the greatest amount of body heat.

What is needed is a helmet for outdoor sports such as snowboarding and skiing that provides an effective ventilation construction and that allows a wearer to maximize, limit, or eliminate air flow to the top of the head. Further, a helmet construction is desired that will allow a user to regulate easily the degree of ventilation for the range of anticipated conditions; e.g., restricting or eliminating ventilation in extremely cold weather or when snow or rain are likely to get into the top of the helmet, or maximizing ventilation in warmer weather.

SUMMARY OF THE INVENTION

The present invention is directed to a simple, yet versatile, helmet construction that not only provides protection to the head, but that also permits the wearer to maximize, limit, or shut off ventilation to the crown, or dome, of the helmet.

In one embodiment, the helmet comprises a protective outer ventilating shell, a liner, a ventilating shutter plate, a shutter plate positioning mechanism and an adjustable strap arrangement. The protective outer ventilating shell is a relatively thin, lightweight, impact-dispersing and puncture-resistant plastic. The shell is contoured upwardly around the facial area and downwardly adjacent the neck area. A shock-absorbing liner is disposed within the inner surface area of the outer protective shell. The liner is formed of an injection molded expanded plastic or styrene material.

A plurality of spaced-apart vents are formed through the outer protective shell and the shock-absorbing liner. The vents, which are elliptically-shaped in one embodiment, are located at spaced intervals in both the front and rear portions of the shell and liner construction. This orientation of vents, often in conjunction with interior channels, facilitates air flow from the front to the rear of the helmet.

The ventilating shutter plate is rotably mounted within a recess in the shock-absorbing liner. In one preferred embodiment, the ventilating shutter is a relatively thin, circular, durable plastic construction. It may be either dome-shaped to correspond to the contour of the helmet, or may be planar. The ventilating shutter plate also has a pattern of spaced-apart apertures formed therethrough. These apertures conform in dimension and position to the vents in the outer protective shell and liner so that they are in substantial registration with one another when the shutter plate is rotated to a first position. The shutter plate is selectively moveable between at least two positions, i.e., a first position where the apertures register with the vents so that the vents are completely open, and a second position wherein the apertures are completely misaligned with the vent openings and the vent openings are completely closed, or blocked, by the shutter plate.

To hold the shutter plate in position within the liner, a liner plate is provided. The liner plate, which is formed of the same material as the liner, is dimensioned to fit within the recess in the liner so that the smooth contour of the total liner is maintained. The liner plate also has slots that correspond in dimension and placement to the vents in outer shell, liner, and shutter plate.

So that a wearer may manually select the position of the shutter plate, the shutter plate positioning mechanism includes a positioning lever connected to the shutter plate for selectively rotating the shutter plate to open and close the vent openings. In its simplest form, the lever that has a fixed end connected to the edge of the shutter plate and a free end that extends through an elongate slot in either the front or rear of the helmet.

In operation, the wearer may selectively move the lever to a plurality of positions within the elongate slot, without having to remove the helmet. Each position of the lever corresponds to a selected position of the apertures in the shutter plate with respect to the vents in the shell and liner. In one embodiment, the lever, and therefore the shutter plate, may have a fully open position, a half-open position, and a fully closed position. The lever is positioned at a low angle relative to the wearer's skull to avoid transferring external impact energy through the helmet to the wearer's skull.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

BRIEF DESCRIPTION OF THE DRAWINGS

FIG. 1 is a right front perspective view of the vented helmet of the present invention;

FIG. 2 is a view of the helmet of FIG. 1, with the protective shell partially cut-away;

FIG. 3 is a left rear perspective view of the helmet of the present invention;

FIG. 4 is a bottom view of the helmet of the present invention showing the plurality of vents in the fully open position;

FIG. 5 is an enlarged view of FIG. 4 with the liner plate removed, showing the alignment of the shutter plate with the plurality of vents in the fully open position;

FIG. 7 is a rear perspective view of the helmet of the present invention showing the plurality of vents in the partially-open position;

FIG. 8 is an enlarged bottom view of FIG. 7 with the liner plate removed, showing the alignment of the shutter plate with the plurality of vents in the half-open position; and FIG. 9 is enlarged bottom view of FIG. 1 with the liner plate removed, showing the alignment of the shutter plate with the plurality of vents in the fully closed position;

DETAILED DESCRIPTION OF THE PREFERRED EMBODIMENTS

Figure 6:
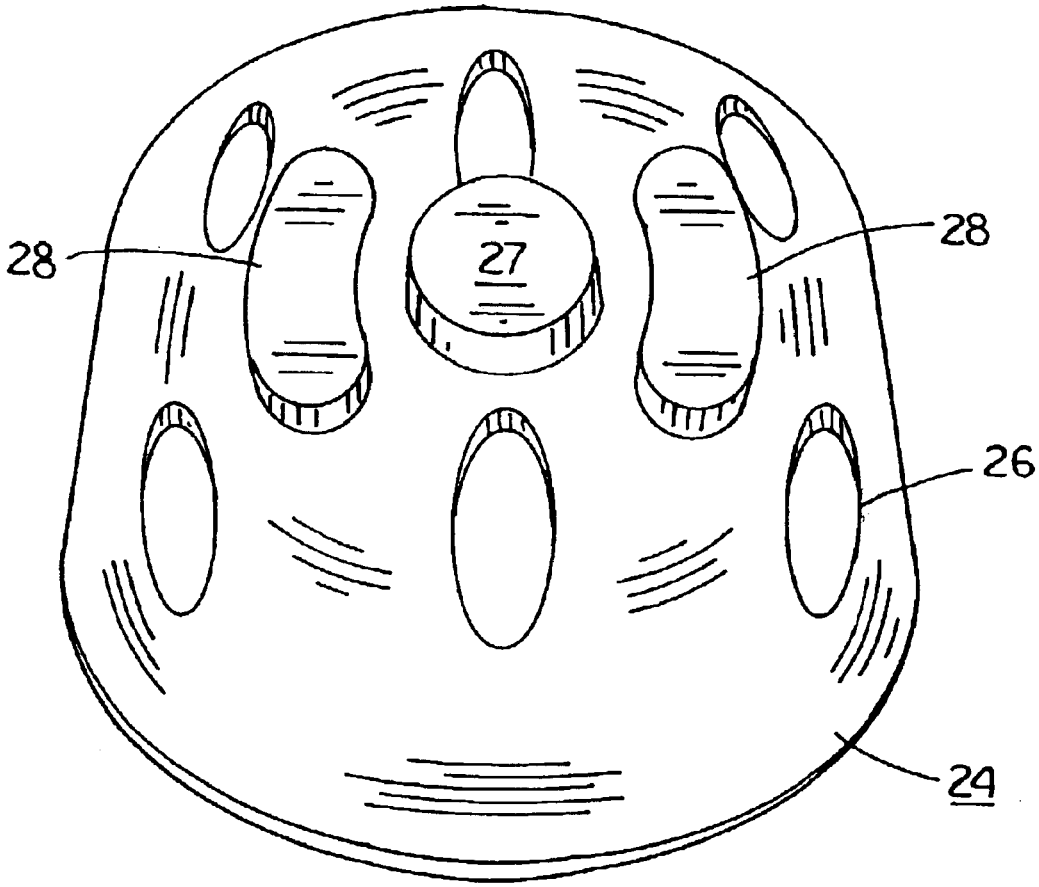
FIG. 6 is a top rear perspective view of the liner plate of the present invention.

Referring now to FIGS. 1 through 3, the present invention is directed to a helmet for protecting a wearer's head during sporting activities, such as skiing or snowboarding. More specifically, the helmet readily permits a wearer to maximize, restrict, or shutoff ventilation to the dome, or crown portion of the helmet. Shown generally as 10, the protective helmet comprises a protective outer ventilating shell 12, a liner 22, an adjustable strap arrangement 32, a ventilation controlling shutter plate 42, and a positioning mechanism 52.

The protective outer ventilating shell 12 is a hard-shell, impact-dispersing plastic that can withstand significant blows and temperature extremes without fracture. It is also puncture-resistant, and lightweight. As will be appreciated by those skilled in the materials arts, an outer ventilating shell 12 with these properties may be molded from polycarbonate or ABS plastic, or other durable composite material. As is conventional in protective helmets, the shell, and thus the helmet, has an upwardly contoured open portion 12*a* adjacent the face of the wearer, and a downwardly contoured portion 12*b* adjacent the back of the neck of the wearer.

A plurality of spaced-apart vents 14 are formed through the outer ventilating shell. It has been found that vents 14 having generally elliptical shapes provide the most desirable, and streamlined, airflow; however the present invention is not limited thereto. The vents 14 are further recessed in the ventilating shell within generally parabolic recesses 13 that facilitate a streamlined flow of air into and out of the upper interior of the helmet 10. As best shown in FIGS. 3 and 7, the vents 14 are formed at spaced intervals in both the front and rear portions of the shell. FIGS. 4 and 5 provide a view of the general orientation of the vents 14 as they appear from the bottom of the helmet 10. While the embodiment illustrated herein has an equal number (3) of front and rear vents, the invention is not limited thereto; rather, for effective ventilation, at least one front vent and one rear vent, or only front or rear vents, may well be sufficient. Further, the sizes of the vents may be varied so that the desired number of vents 14 is either increased or decreased. To facilitate air flow during use, the elliptically-shaped vents 14 are generally oriented with their major axes running from the front to the rear of the helmet 10. Additionally, but not important to the utility of the invention, one or more faux vents 16 may be formed in the shell for ornamental purposes.

Turning now to FIGS. 2 and 4, a lightweight, shock-absorbing liner 22 is disposed within and adhered to substantially the entire inner surface of the shell 12. The liner 22 is made of molded styrene, polystyrene, expanded plastic, or the similar shock-absorbing material. As best seen in FIG. 4, the vents 14 are also formed through the liner 22.

As shown in FIG. 2, a ventilating control shutter plate 42 is disposed within the liner 22; i.e., the shutter plate is positioned within a substantially cylindrical recess that is formed in the liner. The shutter plate 42 may be dome-shaped, spherical, or toroidal/near-spherical, to correspond to the interior contour of the helmet 10, or may be substantially planner. The shutter plate 42, which is desirably formed of a flexible, lightweight, durable plastic, is relatively thin. When made of a flexible material, the shutter plate 42 can accommodate the change in shape required to rotate within the non-spherical or near-spherical recess in the liner 22. The thickness of the shutter plate 42 is not critical, but is related to the economy of space within the liner 22 of the helmet 10. Apertures 44 are formed through the shutter plate 42. The apertures 44 correspond in dimension and relative position to the vents 14 formed through the protective shell 12 and liner 22.

To maintain the shutter plate 42 in position within the liner 22, a liner plate 24 is provided. The liner plate 24 is dimensioned to fit within the recess in the liner so that the smooth contour of the inner liner of the helmet is maintained. The liner plate 24 is formed of the same material as the liner 22 and is adhered to the liner 22 along its peripheral edges. Best shown in FIG. 6, the liner plate has slots 26 that also correspond in dimension and placement to the vents 14 in shell 12 and liner 22, and the apertures 44 in the shutter plate 42. To hold the shutter plate in its desired orientation, and to provide a central hub for rotational movement of for the shutter plate 42, projections 27 and 28 are provided on the innermost side of the liner plate 24. Projection 27 extends through slot 48 in the shutter plate 42 and into recess 27*a* of liner 22 to provide the hub for rotational movement of the shutter plate 42. Optionally, projections 28, which are generally actuate in shape, extend through opposed slots 46 and into recesses 28*a* of the liner 22 to facilitate rotation of the shutter plate 42, without undue lateral shifting or sliding, and provide additional structural support through the shutter plate to maintain the shutter plate recess in the foam liner.

The positioning mechanism 52 of the present invention comprises a lever, or detent, 54 that is either connected to, or integrally formed with the shutter plate 42. The lever 54 is desirably formed of the same durable material as the shutter plate so that it is not easily damaged or broken due to anticipated, repeated use. The lever 54 extends from its fixed end through a slot 56 formed therethrough the liner 22 and the protective shell 12. The lever 54 may have an enlarged end, or more desirably, a knob 58 is affixed to its free end so that the wearer can easily grasp it to manipulate the lever 54. The lever 54 may also be so formed and positioned that it is slightly spring biased either upward or downward against the slot 56. This is possible since the durable plastic is resilient. The bias assists in preventing the lever 54 and the connected shutter plate 42 form shifting or sliding during use. Optionally, indentations 59 may be formed along one edge of the slot 56 to engage the lever, or detent, 54 at some point along the length of the lever 54 to hold the lever 54 in a desired position along the slot 56. This enables the wearer to know which position the lever, or detent, 54, and thus the shutter plate 42, are in and to selectively change their positions by touch, without having to remove the helmet 10. By exerting a small amount of force in the lateral direction the wearer can overcome the spring bias and move the lever, or detent, 54 laterally within the slot 56. The positioning lever, or detent, 54 is also positioned at a low angle relative to the wearer's skull to avoid transferring external impact energy through the helmet to the wearer's skull.

In use, the wearer may manipulate the lever 54 and connected shutter plate 42 to open or close the vents 14 to achieve the desired degree of ventilation into and out of the crown of the helmet 10. For example, referring to FIGS. 2, 3, and 5, when the lever 54 is in position 'A' along slot 56, the apertures 44 of the shutter plate are in complete alignment and registration with the vents 14 so that the vents 14 are completely opened, or unblocked. By sliding the lever 54 to position 'B' along slot 56, the shutter plate is rotated counterclockwise to the position shown in FIGS. 7 and 8. The apertures 44 are then in partial alignment with the vents 14, thereby limiting, or restricting, the air flow. Since the vents 14 and apertures 44 are not geometrically radial about the pivot point of the shutter plate 42, the air flow through the apertures 14 when the lever 54 is in position 'B' is less than half of the air flow potential of position 'A'.

Referring to FIGS. 1 and 9, by moving the lever 54 to position 'C' along slot 56, the shutter plate is rotated further counterclockwise. In this position, the opening to each of the vents 14 are completely blocked and no ventilation is permitted. This position may also be desirable when the wearer wishes to keep rain or snow from entering the top of the helmet.

To ensure the comfort of the helmet 10 and to ensure that the helmet does not fall off during use, a conventional type of strap arrangement 32 is provided. The strap arrangement may be attached to the shell 12 or liner 22 in a number of conventional ways. The straps arrangement 32 comprises left and right ear covers 34*a*, 34*b*, an adjustable chin strap pair 36*a*, 36*b*, and an interlocking buckle assembly 38*a*, 38*b*.

Although the present invention has been described with exemplary constructions, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A helmet for sporting activities, comprising:

(a) a protective shell having a front portion and a rear portion;

(b) a plurality of vents formed through said protective shell, comprising at least one intake vent in the front portion of the protection shell and at least one exhaust vent in the rear portion of the protective shell;

(c) a moveable shutter plate rotatably mounted adjacent said protective shell about a central axis extending through said protective shell, said shutter plate having a plurality of apertures formed therethrough, at least some of said plurality of apertures conforming in dimension and position to said at least one intake vent and said at least one exhaust vent so that said apertures are in substantial registration with said vents when said shutter plate is in a first position; and (d) said shutter plate being selectively moveable between said first position and a second position, wherein the vents are at least partially closed by said shutter plate.

2. The helmet of claim 1 further comprising a shutter plate positioning assembly including:

(a) an elongate slot formed therethrough said protective shell;

(b) a lever extending through said elongate slot, said lever having a free moveable end, and a fixed end connected to said shutter plate; and (c) said free moveable end of said lever being selectively moveable to a plurality of positions within said elongate slot, wherein each position of said lever corresponds to a selected orientation of said plurality of apertures with respect to said plurality of vents.

3. The helmet of claim 1 wherein said shutter plate is a disc.

4. The helmet of claim 1 wherein said shutter plate has a shape selected from the group of shapes consisting of dome, spherical, near-spherical, and toroidal.

5. The helmet of claim 1 further including a positioning member connected to said shutter plate for selectively moving said shutter plate to open and close said vents.

6. The helmet of claim 5 wherein said positioning member is a lever.

7. The helmet of claim 5 wherein a single movement of said positioning member simultaneously opens or closes at least some of said plurality of vents.

8. A ventilated sports helmet, comprising a helmet body having a front and rear with at least one intake vent formed in the front and at least one exhaust vent formed in the rear, a selectively moveable shutter plate rotatably mounted adjacent said at least one intake vent and at least one exhaust vent about a central axis extending through said helmet body, wherein movement of said shutter plate regulates air flow through the at least one intake vent and the at least one exhaust vent.

9. A helmet for sporting activities, comprising:

(a) a protective outer shell having a front portion and a rear portion;

(b) a liner disposed adjacent said protective outer shell;

(c) a plurality of vents formed through said protective outer shell and said liner, comprising at least one intake vent in the front portion of the protective shell and liner and at least one exhaust vent in the rear portion of the protective shell and liner;

(d) a shutter plate rotatably mounted within said liner about a central axis extending through said protective outer shell, said shutter plate having a plurality of apertures formed therethrough, at least some of said plurality of apertures conforming in dimension and position to said at least one intake vent and said at least one exhaust vent so that said apertures are in substantial registration with said vents when said shutter plate is in a first position; and (e) said shutter plate being rotatably moveable between said first position and a second position wherein said vents are at least partially closed by said shutter plate.

10. The helmet of claim 9 further including a positioning member connected to said shutter plate for selectively moving said shutter plate to open and close said vents.

11. The helmet of claim 10 wherein said positioning member is a lever.

12. The helmet of claim 10 wherein a single movement of said positioning member simultaneously opens or closes each of the plurality of vents.

13. The helmet of claim 9 further comprising a shutter plate positioning assembly including:

(a) an elongate slot formed through said protective shell and said liner;

(b) a lever extending through said elongate slot, said lever having a free moveable end, and a fixed end connected to said shutter plate; and (c) said free moveable end of said lever being selectively movable to a plurality of positions within said elongate slot, wherein each position of said lever corresponds to a selected orientation of said plurality of apertures with respect to said plurality of vents.

14. The helmet of claim 9 wherein said lever is positioned at a low angle relative to a wearer's skull to avoid transferring external impact energy through the helmet to the wearer's skull.

* * * * *